US007644760B2

(12) United States Patent
Woloson

(10) Patent No.: US 7,644,760 B2
(45) Date of Patent: Jan. 12, 2010

(54) SELF CONTAINED TEMPERATURE SENSOR FOR BOREHOLE SYSTEMS

(75) Inventor: Scott Woloson, Houston, TX (US)

(73) Assignee: Precision Energy Services, LTD, Calgary, Alberta (CA)

( * ) Notice: Subject to any disclaimer, the term of this patent is extended or adjusted under 35 U.S.C. 154(b) by 361 days.

(21) Appl. No.: 11/306,874

(22) Filed: Jan. 13, 2006

(65) Prior Publication Data

US 2006/0266518 A1 Nov. 30, 2006

Related U.S. Application Data

(60) Provisional application No. 60/650,185, filed on Feb. 7, 2005.

(51) Int. Cl.
*E21B 47/06* (2006.01)

(52) U.S. Cl. ..... 166/250.01; 166/254.1; 166/100; 166/66; 73/152.12

(58) Field of Classification Search ..... 166/250.01, 166/66, 254.1, 100; 73/136, 152.12; 374/136
See application file for complete search history.

(56) References Cited

U.S. PATENT DOCUMENTS 2,633,025 A 3/1953 Boice et al.
2,676,489 A 4/1954 Basham
3,745,822 A 7/1973 Pierce et al.
5,136,525 A 8/1992 Cloud
5,347,859 A * 9/1994 Henneuse et al. ..... 73/152.48
2002/0043369 A1* 4/2002 Vinegar et al. ..... 166/250.07
2003/0183384 A1 10/2003 Das et al.

FOREIGN PATENT DOCUMENTS

GB 2193239 2/1988
GB 2328746 3/1999

OTHER PUBLICATIONS http://dictionary.reference.com/browse/remove.*
http://dictionary.reference.com/browse/remove; 2008.*
GB Search Report, Feb. 28, 2006, 4 pages.

* cited by examiner

*Primary Examiner*—David J Bagnell
*Assistant Examiner*—Sean D Andrish
(74) *Attorney, Agent, or Firm*—Wong, Cabello, Lutsch, Rutherford & Brucculeri, L.L.P.

(57) ABSTRACT

A sensor assembly that responds to temperature of fluids within an annulus formed by an outer surface of a borehole instrument and the wall of a borehole. The sensor assembly is removably installed preferably in the wall of the borehole instrument. Installation and removal are from outside of the borehole instrument thus eliminating the need to disassemble the borehole instrument. The sensor assembly comprises a temperature transducer that is hermetically sealed within a housing designed to obtain maximum thermal exposure of the transducer. Power to the temperature transducer is supplied from a separate electronics package in the borehole instrument through a rotary connector within the sensor housing.

28 Claims, 4 Drawing Sheets

SELF CONTAINED TEMPERATURE SENSOR FOR BOREHOLE SYSTEMS

CROSS-REFERENCE TO RELATED APPLICATION

This application claims priority under 35 U.S.C. § 119(e) to U.S. provisional patent application Ser. No. 60/650,185, filed Feb. 7, 2005, which is incorporated herein by reference in its entirety

BACKGROUND OF THE INVENTION

This invention is directed toward the measure of temperature, and more particularly toward a sensor for measuring temperature of well borehole environs in the vicinity of a borehole instrument that is conveyed along the borehole. The temperature sensor is removably disposed preferably within the wall of the borehole instrument. The sensor can be embodied in a wide variety of borehole exploration and testing equipment including measurement-while-drilling, logging-while-drilling, and wireline systems.

FIELD OF THE INVENTION

Borehole geophysics encompasses a wide variety of measurements made with an equally wide variety of apparatus and methods. Measurements can be made during the drilling operation to optimize the drilling process, where borehole instrumentation is conveyed by a drill string. These measurements are made with systems commonly referred to as measurement-while-drilling or "MWD" systems. It is also of interest to measure, while drilling, properties of formation materials penetrated by the drill bit. These measurements are made with systems commonly referred to as logging-while-drilling or "LWD" systems, and borehole instrumentation is again conveyed by a drill string. Subsequent to the drilling operation, borehole and formation properties can be made with systems commonly referred to as "wireline" systems, with borehole instrument being conveyed typically by a multiconductor cable. Various types of formation testing is also performed both during the drilling of the borehole, and after the borehole has been drilled or "completed", using drill string conveyed and wireline conveyed instrumentation.

The temperature of fluid within the borehole is a parameter of interest in virtually all types of geophysical exploration. A measure of temperature of liquid or gas within the annulus formed by the borehole wall and the borehole instrument is of particular interest. A variation in annulus temperature at a particular depth within the borehole can indicate formation liquid or gas entering or leaving the borehole at that depth. Such information can, in turn, be related to formation fracturing, formation damage, wellbore tubular problems, and the like. A measure of annulus temperature as a function of depth can define thermal gradients which, in turn, can be related to a variety of geophysical parameters and conditions of interest. Certain electromagnetic, acoustic and nuclear formation evaluation logging systems, both drill string and wireline conveyed, require corrections for annulus temperature in order to maximize measurement accuracy and precision.

From the brief discussion above, it is apparent that methods and apparatus for measuring annulus temperature are critical to a wide variety of geophysical operations. It is desirable that an annulus temperature measurement system be accurate and precise. It is further desirable for the measurement system to respond rapidly to any changes in temperature. Ruggosity is required for the harsh conditions typically encountered a borehole environment. Operationally, it is desirable to dispose an annulus temperature sensor in the wall of the borehole instrument defining the annulus. Furthermore, it is operationally advantageous if the sensor can be easily removed and replaced from the outside of the borehole instrument therefore removing the need to dismantle the instrument. As an example, sensors may be designed for maximum response in a given temperature range. If the range is exceeded, it is advantageous to replace the sensor optimized for another range. Ease of replacement is also operationally advantageous in the event of sensor failure.

BRIEF SUMMARY OF THE INVENTION

The present invention comprises a sensor assembly that responds to temperature of fluids within an annulus formed by an outer surface of a borehole instrument and the wall of a borehole. The sensor assembly is removably installed preferably in the wall of the borehole instrument. Installation and removal are from outside of the borehole instrument thus eliminating the need to disassemble the instrument. The sensor assembly comprises a temperature transducer that is hermetically sealed within a housing. The housing is designed to obtain maximum thermal exposure of the transducer. This yields optimum thermal response of the transducer to temperature variations in the surrounding annulus environment. The sensor is designed to operate at high temperature, high pressure, and high vibration/shock typically encountered in the borehole environment. The sensor assembly housing has a locking feature to ensure that it remains in the borehole instrument during operation. Power to the temperature transducer is supplied from a separate electronics package in the borehole instrument through a rotary connector within the sensor housing. Response of the temperature transducer is received, through the same rotary connector, by the electronics package for processing and transmission via a suitable telemetry system to the surface of the earth.

BRIEF DESCRIPTION OF THE DRAWINGS

So that the manner in which the above recited features, advantages and objects the present invention are obtained and can be understood in detail, more particular description of the invention, briefly summarized above, may be had by reference to the embodiments thereof which are illustrated in the appended drawings.

DETAILED DESCRIPTION OF THE PREFERRED EMBODIMENT

Figure 1:
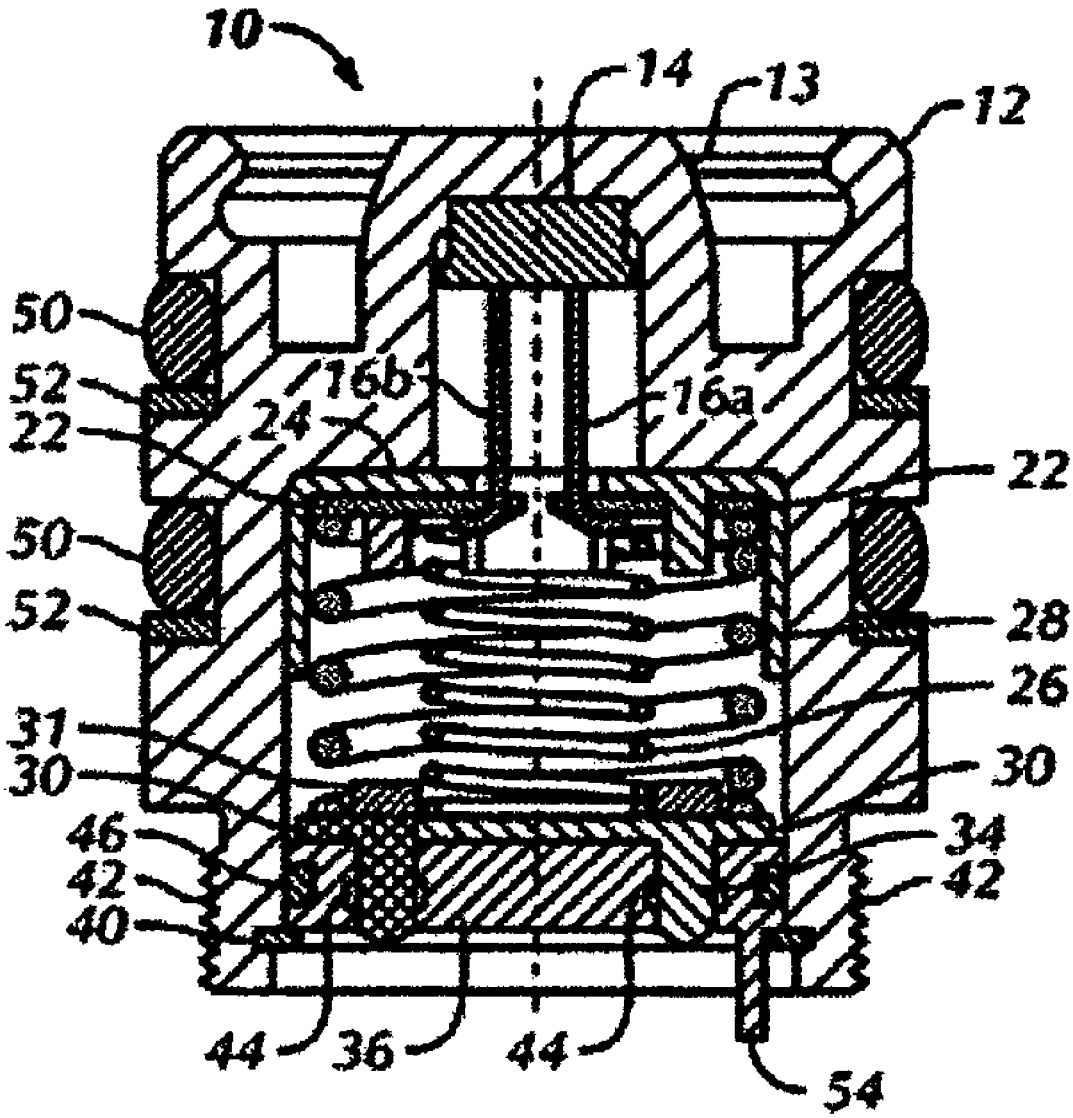
FIG. 1 is a cross sectional view of the temperature sensor assembly.

FIG. 1 is a cross sectional view of the temperature sensor assembly 10. Internal elements of the assembly 10 are hermetically sealed within a cylindrical housing 12. The housing material is preferably beryllium-copper, although other metals or alloys such as Inconel can be used. The top or "outer" end of the housing 12, as will be shown in subsequent illustrations, is exposed to borehole fluid. This outer end comprises a protrusion 13. A temperature transducer 14 is disposed inside of the housing and positioned within the protrusion 13. The transducer 14 is in thermal contact with the housing 12, and is preferably soldered to the housing to insure good thermal contact. This arrangement surrounds, as much as practical, the temperature transducer 14 with borehole fluid thereby maximizing the response of the temperature transducer to borehole fluid temperature. Electrical leads 16*a* and 16*b* from the temperature transducer 14 extend through an "upper" connector assembly. The upper connector comprises an upper insulating base member 24, and outer electrical contact 22, and an inner electrical contact 18. The electrical leads 16*a* and 16*b* terminate at the electrical contacts 18 and 22, respectfully.

Still referring to FIG. 1, a large spring 28 and a small spring 26 are positioned coaxially within the housing 12. The upper end of the large spring 28 is in electrical contact with the outer electrical contact 22, and the upper end of the small spring 26 is in electrical contact with the inner electrical contact 18. Opposing or lower ends of the large spring 28 and small spring 26 contact a rotary connector assembly. The rotary connector assembly or "rotary connector" is illustrates as a whole in FIG. 2, and designated by the numeral 41. The assembly 41 comprises an outer sensor contact 30 which is in electrical contact with the large spring 28, and an inner sensor contact 34 which is in electrical contact with the small spring 26. An insulator ring 31 separates the two sensor contacts 30 and 34. The large and small springs 28 and 26, respectively, serve as electrical conductors between the temperature transducer 14 and the rotary connector assembly 41. Both springs also provide a mechanical load to the rotary connector assembly 41. The rotary connector assembly 41, large spring 28 and small spring 26 are retained in the housing 12 by a retaining ring 40. The rotary connector assembly 41 also comprises an electrical insulating base member 36 forming an insulating ring 31 containing alignment indentions 33. The insulating base member 36 defines the lower or "inner" end of the sensor 10, and is penetrated by extensions of the sensor contacts 30 and 34 in the form of protrusions, as shown in FIG. 1. These protrusions are hermetically sealed with O-rings rings 44. The insulating base 36 is hermetically sealed to the interior of the housing 12 by an O-ring 46. The insulating base 36 also has an alignment tab 54 which properly aligns the rotary connector assembly 41 within the borehole instrument wall in which it is received. Alignment will be discussed in a subsequent section of this disclosure.

The temperature sensor assembly 10 is threaded into a cylindrical receptacle in the wall of the borehole instrument via the threads 42. Hermetic sealing between the housing 12 and the borehole instrument receptacle is provided by O-rings 50 and cooperating back-up rings 52.

Figure 2:
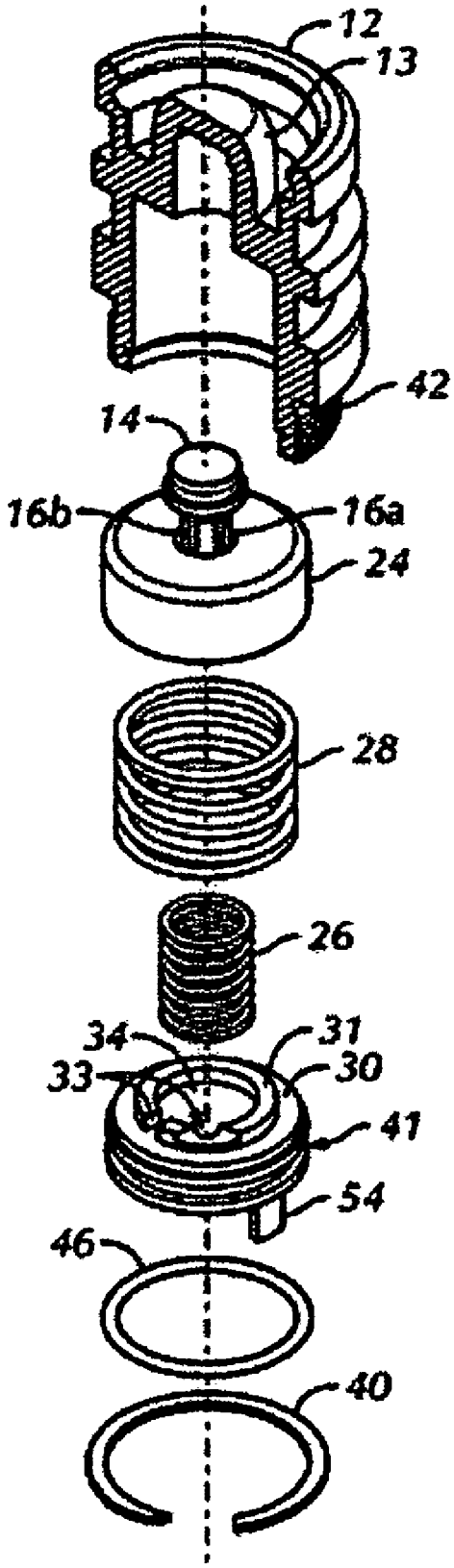
FIG. 2 is an exploded view of major elements of the temperature sensor assembly.

FIG. 2 is an exploded view of major elements of the temperature sensor assembly 10, and best illustrates the functionality of the rotary connector assembly which allows the temperature sensor to be inserted and removed from the wall of a borehole instrument. The housing 12, transducer 14, upper base member and connector assembly 24, large spring 28, and small spring 26 all rotate with respect to the rotary connector assembly 41. As the housing 12 is threading into or out of the borehole instrument wall, the O-ring 46 maintains a hermetic seal within the housing 12 as it is rotated with respect to the rotary connector assembly 41. The rotary connector assembly 41 is held fixed with respect to the wall of the borehole instrument by the alignment tab 54 which is received in a slot within the wall of the borehole instrument. Hermetic seal between the outer surface of the sensor housing 12 and the cylindrical borehole instrument receptacle is maintained by the O-rings and back-up rings 50 and 52, respectfully, as the sensor assembly 10 is threaded into or out of the wall of the borehole instrument. The outer end of the housing 12 is fabricated to receive an appropriate means for turning, such as an Allen wrench or the like.

Figure 3:
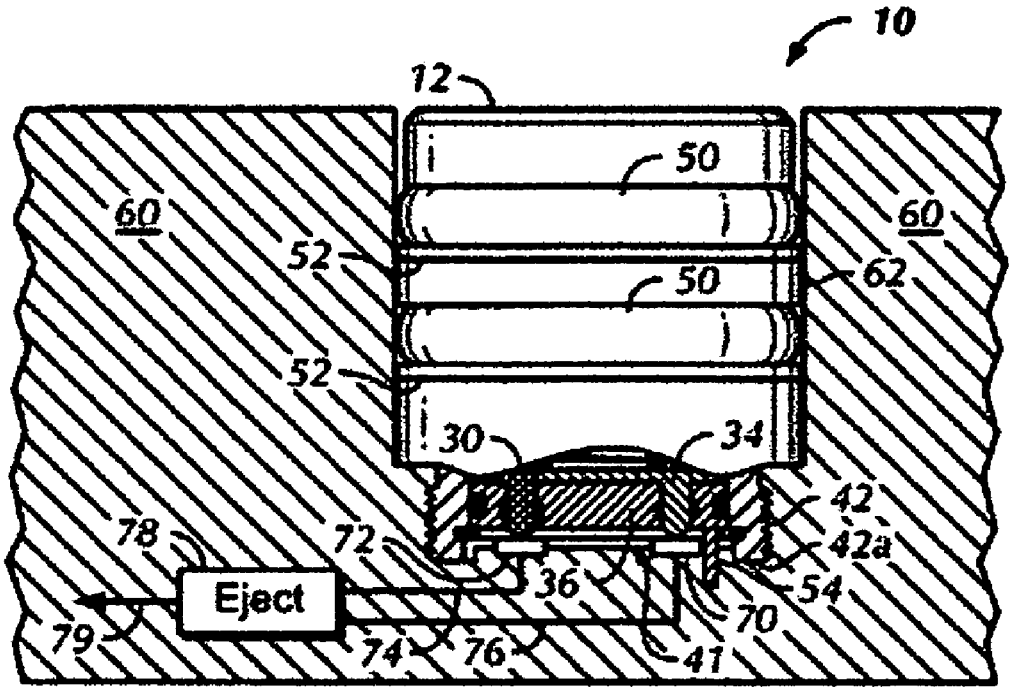
FIG. 3 is a sectional view of the temperature sensor assembly mounted in a cylindrical receptacle in the wall of a borehole instrument.

FIG. 3 is a sectional view of the temperature sensor assembly 10 mounted in a cylindrical receptacle 62 in the wall 60 of a borehole instrument. O-rings 50 and back-up rings 52 are shown hermetically sealing the housing 12 within the wall 60 of the borehole instrument. The lower portion of the temperature sensor assembly 10 is cut away to show the cooperation of the elements of the rotary connector assembly 41 with elements of the borehole instrument wall. The male threads 42 on the housing 12 are received by corresponding female threads 42*a* cut at the base of the receptacle 62. The alignment tab 54 is received by a slot in the borehole instrument wall 60 so that the rotary connector assembly is held fixed with respect to the instrument wall. The alignment tab 54 is also positioned so that the sensor contacts 30 and 34 are aligned and make electrical contact with corresponding borehole instrument or "tool" contacts 72 and 70, respectfully. Power for the temperature transducer 14 (see FIGS. 1 and 2) is supplied by an appropriate power supply in an electronics package 78 via electrical leads 74 and 76 which terminate at the tool contacts 72 and 70, respectively. The electronics package 78 and leads 74 and 76 are hermetically sealed within the borehole instrument wall. The sensor and tool contact arrangement allows the temperature sensor 10 to be inserted into and removed from the instrument wall 60 without disturbing the "tool" hermetic seal of elements within the instrument wall 60. Response of the temperature transducer 12 is conveyed from the sensor assembly 10 via the sensor contacts 30 and 34 through the tool contacts 72 and 70 and to the electronics package 78 via the leads 74 and 76. Temperature sensor response is typically telemetered from the electronics package 78 to the surface of the earth for processing and use, as illustrated conceptually with the arrow 79. Optionally, the sensor response can be processed within the electronics package 78. These processed results can be recorded in the electronics package, or used to control or correct functions of other sensors or equipment disposed within the borehole instrument.

As shown in FIG. 3, the housing 12 is disposed entirely within a radius defined by the outer surface of the borehole instrument wall 60. Alternately, the housing 12 can protrude outside of the radius defined by the outer surface of the borehole instrument wall 60.

Figure 3A:
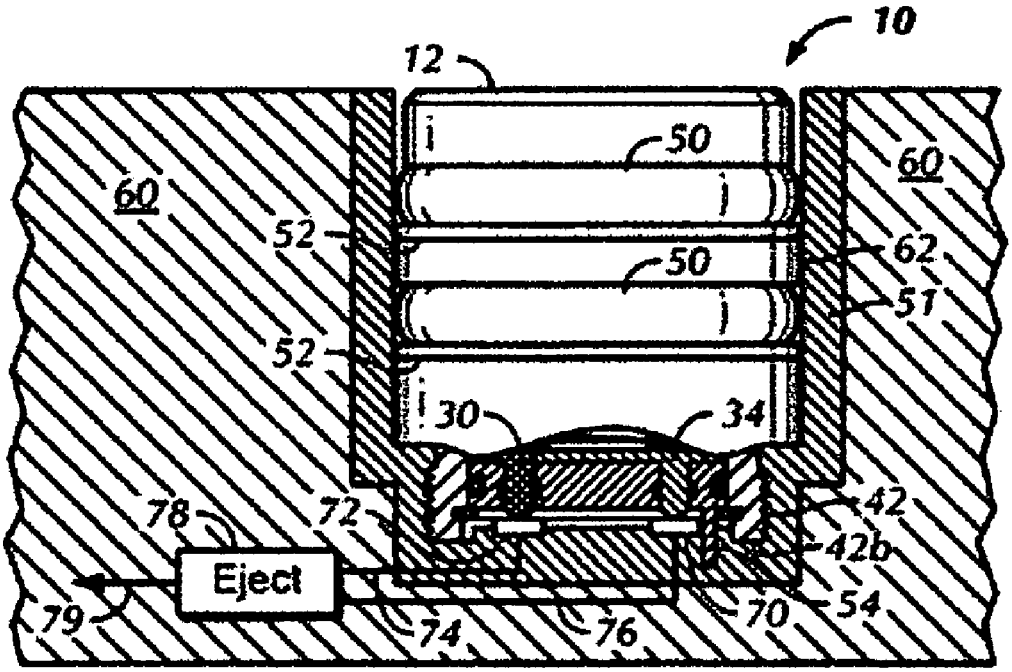
FIG. 3A is a sectional view of the temperature sensor assembly mounted in a thermal isolator insert and within a cylindrical receptacle in the wall of a borehole instrument and FIG. 4 illustrates conceptually the temperature sensor assembly disposed in a well borehole for measuring temperature of borehole fluids.

It is advantageous for the temperature sensor assembly 10 to respond to changes in drilling fluid temperature as quickly as possible. The wall 60 of the borehole instrument is typically massive and does not, therefore, rapidly reach thermal equilibrium with the drilling fluid temperature. Response of the temperature sensor assembly 10 to changes in drilling fluid temperature can, therefore, be maximized by thermally isolating the temperature sensor assembly 10, and the transducer 14 therein, from the wall 60 of the borehole instrument. One method for thermal sensor assembly isolation is shown in FIG. 3A. The cylindrical receptacle 62 in the wall 60 of the borehole instrument is lined with a thermal isolator insert 51. The thermal isolator insert 51 is fabricated from any suitable temperature insulating material, such as composite graphite or thermal plastic, that can function within the typically harsh borehole environment. The male threads 42 on the housing 12 are received by corresponding female threads 42*b* cut at the base of the thermal isolator insert 51. The alignment tab 54 is received by a slot in the thermal isolator insert 51 so that the rotary connector assembly is held fixed with respect to the instrument wall, as is the case in the embodiment shown in FIG. 3. Once again, the alignment tab 54 is positioned so that the sensor contacts 30 and 34 are aligned and make electrical contact with corresponding contacts 72 and 70, respectfully. Power for the temperature transducer 14 is again supplied by an appropriate power supply in an electronics package 78 via electrical leads 74 and 76. The leads 74 and 76 are disposed within the borehole instrument wall 60 and within the thermal isolator insert 51, and terminate at the tool contacts 72 and 70, respectively. FIG. 3A illustrates one means for thermally isolating the temperature transducer 14 from the wall 60 of the borehole instrument. It should be understood that the desired thermal isolation of the temperature transducer 14 can be obtained using other embodiments, such as fabricating the housing 12 with a thermally insulating material.

Figure 4:
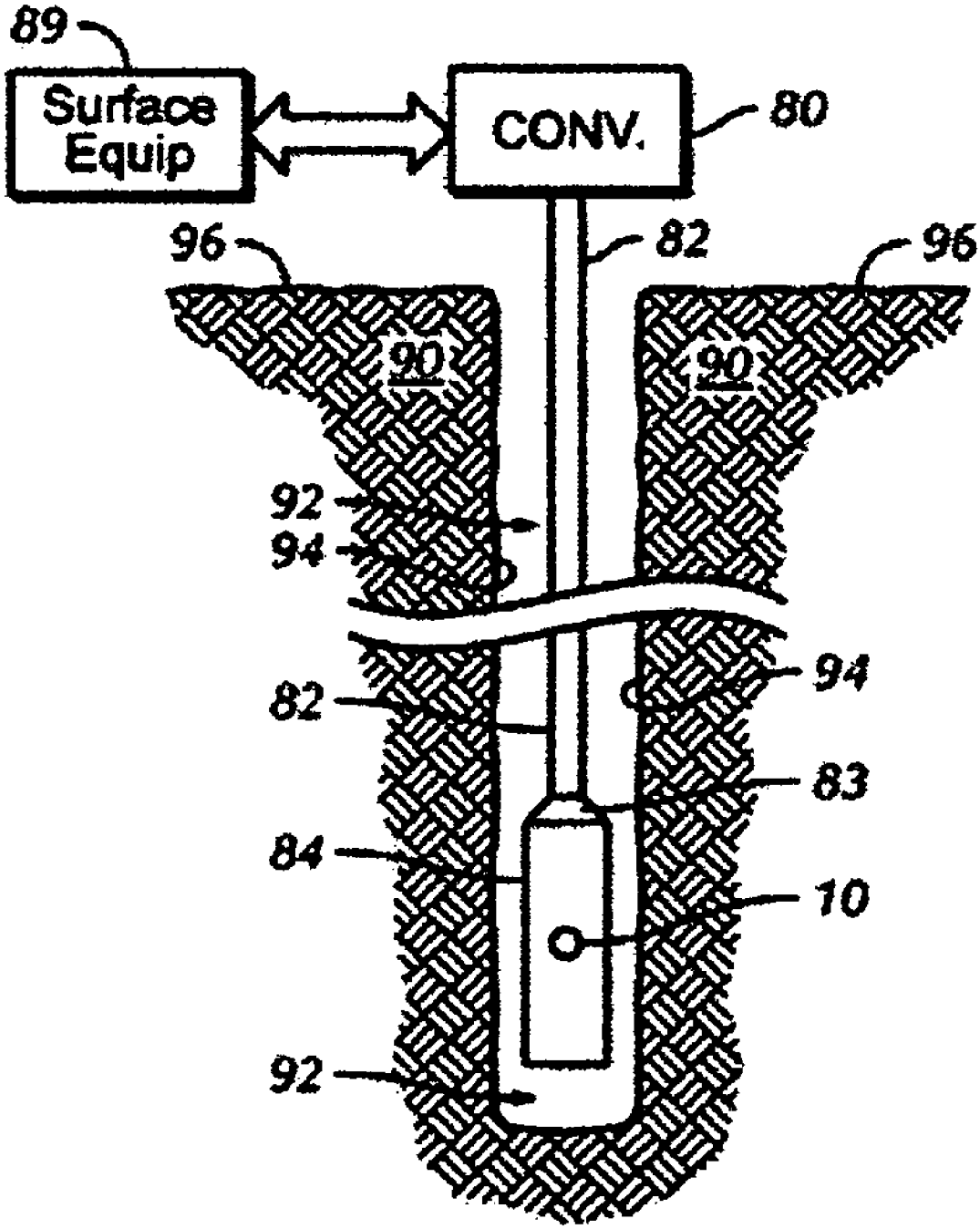

FIG. 4 illustrates conceptually the temperature sensor assembly 10 disposed in a well borehole for measuring temperature of borehole fluids. A borehole instrument 84 is suspended in a well borehole 92 that penetrates earth formation 90. The borehole instrument is operationally connected to a lower end of a data conduit 82 by a suitable connector 83. The upper end of the data conduit 82 is operationally connected to a conveyance means 80 at the surface 96 of the earth. The conveyance means 80 is operationally connected to surface equipment 89 which can power and transmit down-link data to the borehole instrument 10, and receive and process up-link data transmitted from the temperature sensor assembly 10 and other instrumentation within the borehole instrument 84. The temperature sensor 10 responds primarily to temperature of borehole fluid in the annulus defined by the outer surface of the borehole instrument 84 and the wall 94 of the borehole 92.

As mentioned previously, the temperature sensor assembly 10 can be embodied in LWD, MWD, wireline and other types of borehole systems. If embodied in an LWD or MWD system, the borehole instrument 84 is typically a drill collar, the data conduit 82 is a drill string, and the conveyance means 80 is a rotary drilling rig which incorporates an appropriate telemetry system, such as a mud pulse system. If embodied in a wireline system, the borehole instrument 84 is typically a cylindrical pressure housing, the data conduit 82 is a logging cable cooperating with a suitable up-hole and down-hole telemetry system, and the conveyance means 80 is a wireline draw works assembly.

While the foregoing disclosure is directed toward the preferred embodiments of the invention, the scope of the invention is defined by the claims, which follow.

What is claimed is:

1. A temperature sensor comprising:

(a) a cylindrical housing;

(b) a temperature transducer disposed within said housing; and (c) a rotary connector disposed within said housing and cooperating with said temperature transducer; wherein (i) said temperature sensor is removably disposable within a wall of a borehole instrument from an outer surface of said wall, and (ii) said temperature sensor comprises at least one small spring coaxially disposed within at least one large spring, wherein said large spring and said small spring are disposed within said housing and are electrical conductors between said temperature transducer and said rotary connector.

2. The temperature sensor of claim 1 further comprising means for hermetically sealing said temperature transducer and said rotary connector within said housing such that said hermetic seal is maintained during said insertion or removal of said temperature sensor.

3. The temperature sensor of claim 2 further comprising:

(a) sensor contacts protruding from an inner end of said temperature sensor; and (b) an alignment tab protruding from said inner end; wherein (c) said alignment tab aligns said sensor contacts with tool contacts so that a tool hermetic seal is maintained within said borehole instrument wall during said insertion or removal of said temperature sensor.

4. The temperature sensor of claim 1 wherein an outer end of said housing comprises a protrusion and said temperature transducer is positioned within and thermally coupled to said protrusion.

5. The temperature sensor of claim 4 wherein said protrusion is within a radius defined by an outer surface of said wall of said borehole instrument.

6. The temperature sensor of claim 1 wherein said borehole instrument is conveyed with a drill string.

7. The temperature sensor of claim 1 wherein said borehole instrument is conveyed by a wireline.

8. The temperature sensor of claim 1 wherein said transducer is thermally isolated from said wall of said borehole instrument.

9. A method for determining temperature of fluid within a borehole, the method comprising:

(a) providing a temperature sensor comprising a cylindrical housing;

(b) disposing a temperature transducer within said housing;

(c) disposing a rotary connector, within said housing, that (i) is electrically connected to said temperature transducer, and (ii) remains stationary with respect to rotation of said housing and said temperature transducer;

(d) removably disposing said temperature sensor within a wall of a borehole instrument from an outer surface of said wall;

(e) disposing, within said housing, at least one small spring coaxially within at least one large spring wherein said small spring and said large spring provide said electrical connection between said temperature transducer and said rotary connector; and (f) from a response of said temperature transducer, determining temperature of said borehole fluid in an annulus formed by said outer surface of said borehole instrument wall and a wall of said borehole.

10. The method of claim 9 further comprising hermetically sealing said temperature transducer and said rotary connector within said housing such that said hermetic seal is maintained during said insertion or removal of said temperature sensor.

11. The method of claim 10 further comprising:

(a) providing sensor contacts that protrude from an inner end of said temperature sensor; and (b) providing an alignment tab that protrudes from said inner end; wherein (c) said alignment tab aligns said sensor contacts with tool contacts so that a tool hermetic seal is maintained within said borehole instrument wall during said insertion or removal of said temperature sensor.

12. The method of claim 9 further comprising:

(a) forming a protrusion in an outer end of said housing;

(b) positioning said temperature transducer within said protrusion; and (c) thermally coupling said temperature transducer to said protrusion.

13. The method of claim 12 wherein said protrusion is within a radius defined by an outer surface of said wall of said borehole instrument.

14. The method of claim 9 further comprising thermally isolating said temperature transducer from said wall of said borehole instrument.

15. The method of claim 9 further comprising conveying said borehole instrument within said borehole with a drill string.

16. The method of claim 9 further comprising conveying said borehole instrument within said borehole with a wireline.

17. A borehole instrument for measuring temperature of borehole fluid in an annulus defined by an outer surface of a wall of said instrument and a wall of said borehole, the instrument comprising:

(a) a temperature sensor comprising
  (i) a cylindrical housing,
  (ii) a temperature transducer disposed within said housing, and
  (iii) a rotary connector disposed within said housing and with sensor contacts electrically connected to said temperature transducer, wherein said sensor contacts and an alignment tab protrude from an inner end of said temperature sensor; and (b) tool contacts disposed within a receptacle in said wall of said borehole instrument; wherein (c) said temperature sensor is removably disposable by threading within said receptacle from said outer surface of said borehole instrument; and (d) said tool contacts are aligned by said alignment tab with said sensor contacts thereby establishing electrical contact between said temperature transducer and an electronics package within said borehole instrument wall when said temperature sensor is threaded into said receptacle.

18. A borehole instrument for measuring temperature of borehole fluid in an annulus defined by an outer surface of a wall of said instrument and a wall of said borehole, the instrument comprising:

(a) a temperature sensor comprising
  (i) a cylindrical housing,
  (ii) a temperature transducer disposed within said housing, and
  (iii) a rotary connector disposed within said housing and with sensor contacts electrically connected to said temperature transducer, wherein said sensor contacts and an alignment tab protrude from an inner end of said temperature sensor; and (b) tool contacts disposed within a receptacle in said wall of said borehole instrument; wherein (c) said temperature sensor is removably disposable by threading within said receptacle from said outer surface of said borehole instrument;

(d) said tool contacts are aligned by said alignment tab with said sensor contacts thereby establishing electrical contact between said temperature transducer and an electronics package within said borehole instrument wall when said temperature sensor is threaded into said receptacle; and (e) at least one small spring coaxially is disposed within at least one large spring, and said large spring and said small spring are disposed within said housing and comprise said electrical connection between said temperature transducer and said sensor contacts.

19. The instrument of claim 18 wherein:

(a) an outer end of said housing comprises a protrusion and said temperature transducer is positioned within and thermally coupled to said protrusion; and (b) said protrusion is within a radius defined by said outer surface of said borehole instrument.

20. The instrument of claim 18 wherein said temperature sensor is thermally isolated from said wall of said borehole instrument.

21. The instrument of claim 18 wherein said borehole instrument is conveyed with a drill string.

22. The instrument of claim 18 wherein said borehole instrument is conveyed by a wireline.

23. A method for measuring temperature of borehole fluid in an annulus defined by an outer surface of a wall of a borehole instrument and a wall of said borehole, the method comprising:

(a) providing a temperature sensor comprising
  (i) a cylindrical housing,
  (ii) a temperature transducer disposed within said housing, and
  (iii) a rotary connector disposed within said housing and with sensor contacts electrically connected to said temperature transducer, wherein said sensor contacts and an alignment tab protrude from an inner end of said temperature sensor;

(b) disposing tool contacts within a receptacle in said wall of said borehole instrument;

(c) removably disposing said temperature sensor by threading within said receptacle from said outer surface of said wall of borehole instrument;

(d) aligning said tool contacts with said sensor contacts by means of said alignment tab thereby establishing electrical contact between said temperature transducer and an electronics package within said borehole instrument wall when said temperature sensor is threaded into said receptacle; and (e) determining temperature of said borehole fluid from a response of said temperature sensor.

24. A method for measuring temperature of borehole fluid in an annulus defined by an outer surface of a wall of a borehole instrument and a wall of said borehole, the method comprising:

(a) providing a temperature sensor comprising
  (i) a cylindrical housing,
  (ii) a temperature transducer disposed within said housing, and
  (iii) a rotary connector disposed within said housing and with sensor contacts electrically connected to said temperature transducer, wherein said sensor contacts and an alignment tab protrude from an inner end of said temperature sensor;

(b) disposing tool contacts within a receptacle in said wall of said borehole instrument;

(c) removably disposing said temperature sensor by threading within said receptacle from said outer surface of said wall of borehole instrument;

(d) aligning said tool contacts with said sensor contacts by means of said alignment tab thereby establishing electrical contact between said temperature transducer and an electronics package within said borehole instrument wall when said temperature sensor is threaded into said receptacle;

(e) disposing, within said housing, at least one small spring coaxially within at least one large spring, wherein said large spring and said small spring comprise said electrical connection between said temperature transducer and said sensor contacts; and (f) determining temperature of said borehole fluid from a response of said temperature sensor.

25. The method of claim 24 further comprising:

(a) forming a protrusion at an outer end of said housing;

(b) positioning said temperature transducer within said protrusion; and (c) thermally coupling said temperature transducer to said protrusion; wherein (d) said protrusion is within a radius defined by said outer surface of said wall of said borehole instrument.

26. The method of claim 24 further comprising thermally isolating said temperature sensor from said wall of said borehole.

27. The method of claim 24 further comprising conveying said borehole instrument with a drill string.

28. The method of claim 24 further comprising conveying said borehole instrument with a wireline.

* * * * *

UNITED STATES PATENT AND TRADEMARK OFFICE

CERTIFICATE OF CORRECTION

PATENT NO. : 7,644,760 B2
APPLICATION NO. : 11/306874
DATED : January 12, 2010
INVENTOR(S) : Scott Woloson It is certified that error appears in the above-identified patent and that said Letters Patent is hereby corrected as shown below:

On the Title page,

[*] Notice: Subject to any disclaimer, the term of this patent is extended or adjusted under 35 USC 154(b) by 361 days Delete the phrase "by 361 days" and insert -- by 558 days --

Signed and Sealed this

Fifteenth Day of June, 2010

David J. Kappos

David J. Kappos
*Director of the United States Patent and Trademark Office*